US007880385B2

(12) United States Patent
Kyushima et al.

(10) Patent No.: US 7,880,385 B2
(45) Date of Patent: Feb. 1, 2011

(54) PHOTOMULTIPLIER INCLUDING AN ELECTRONIC-MULTIPLIER SECTION IN A HOUSING

(75) Inventors: Hiroyuki Kyushima, Hamamatsu (JP); Hideki Shimoi, Hamamatsu (JP); Hiroyuki Sugiyama, Hamamatsu (JP); Hitoshi Kishita, Hamamatsu (JP); Suenori Kimura, Hamamatsu (JP); Yuji Masuda, Hamamatsu (JP); Takayuki Ohmura, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 388 days.

(21) Appl. No.: 11/921,959

(22) PCT Filed: Jun. 1, 2006

(86) PCT No.: PCT/JP2006/311009

§ 371 (c)(1),
(2), (4) Date: Dec. 11, 2007

(87) PCT Pub. No.: WO2007/017984

PCT Pub. Date: Feb. 15, 2007

(65) Prior Publication Data

US 2009/0045741 A1 Feb. 19, 2009

(30) Foreign Application Priority Data

Aug. 10, 2005 (JP) ..... P2005-232535

(51) Int. Cl.
*H01J 43/04* (2006.01)
*H01J 43/18* (2006.01)
*H01J 43/00* (2006.01)

(52) U.S. Cl. ..... 313/533; 313/532; 313/534; 313/536; 313/540; 313/542

(58) Field of Classification Search ..... 313/532–535
See application file for complete search history.

(56) References Cited

U.S. PATENT DOCUMENTS

| | | | | |
|---|---|---|---|---|
| 3,244,922 | A * | 4/1966 | Wolfgang | 313/534 |
| 5,264,693 | A | 11/1993 | Shimabukuro et al. | |
| 5,329,110 | A | 7/1994 | Shimabukuro et al. | |
| 5,481,158 | A * | 1/1996 | Kato et al. | 313/533 |
| 5,568,013 | A | 10/1996 | Then et al. | |
| 5,880,458 | A * | 3/1999 | Shimoi et al. | 250/207 |
| 6,166,365 | A * | 12/2000 | Simonetti et al. | 250/207 |

(Continued)

FOREIGN PATENT DOCUMENTS

| | | |
|---|---|---|
| JP | 61-96645 | 5/1986 |

(Continued)

*Primary Examiner*—Sikha Roy
(74) *Attorney, Agent, or Firm*—Drinker Biddle & Reath LLP

(57) ABSTRACT

The present invention relates to a photomultiplier having a fine structure capable of realizing high detection accuracy by effectively suppressing cross talk among electron-multiplier channels. The photomultiplier comprises a housing whose inside is maintained vacuum, and, in the housing, a photocathode, an electron-multiplier section, and anodes are disposed. The electron-multiplier section has groove portions for cascade-multiplying photoelectrons as electron-multiplier channels, and the anodes are constituted by channel electrodes corresponding to the groove portions respectively defined by wall parts. In particular, at least parts of the respective channel electrodes are located in spaces sandwiched between pairs of wall parts defining the corresponding groove portions.

4 Claims, 9 Drawing Sheets

U.S. PATENT DOCUMENTS

| | | | | |
|---|---|---|---|---|
| 6,492,657 | B1 * | 12/2002 | Burlefinger et al. | 257/10 |
| 7,049,747 | B1 | 5/2006 | Goodberlet et al. | |
| 7,294,954 | B2 | 11/2007 | Syms | |

FOREIGN PATENT DOCUMENTS

| | | |
|---|---|---|
| JP | 64-7465 | 1/1989 |
| JP | 4-359855 | 12/1992 |
| JP | 11-329339 | 11/1999 |
| JP | 3078905 | 6/2000 |
| WO | WO 2005/078759 | 8/2005 |

* cited by examiner (a)

(b)

PHOTOMULTIPLIER INCLUDING AN ELECTRONIC-MULTIPLIER SECTION IN A HOUSING

TECHNICAL FIELD

The present invention relates to a photomultiplier which has an electron-multiplier section cascade-multiplying photoelectrons generated by a photocathode.

BACKGROUND ART

Conventionally, photomultipliers (PMT: Photo-Multiplier Tube) have been known as optical sensors. A photomultiplier comprises a photocathode that converts light into electrons, a focusing electrode, an electron-multiplier section, and an anode, and is constituted so as to accommodate those in a vacuum case. In a photomultiplier, when s incident into a photocathode, photoelectrons are emitted from the photocathode into a vacuum case. The photoelectrons are guided to an electron-multiplier section by a focusing electrode, and are cascade-multiplied by the electron-multiplier section. An anode outputs, as signals, electrons having reached among multiplied electrons (for example, see the following Patent Document 1 and Patent Document 2).

Patent Document 1: Japanese Patent No. 3078905

Patent Document 2: Japanese Patent Application Laid-Open No. 4-359855

DISCLOSURE OF THE INVENTION

Problems that the Invention is to Solve

The inventors have studied the conventional photomultiplier in detail, and as a result, have found problems as follows.

That is, as optical sensors expand in application, smaller photomultipliers are desired. On the other hand, accompanying such downsizing of photomultipliers, a high-precision processing technology has been required for components constituting the photomultipliers. In particular, when the miniaturization of components themselves is advanced, it is increasingly hard to realize an accurate layout among the components, which makes it impossible to obtain high detection accuracy, and leads to a great variation in detection accuracy of each of the manufactured photomultipliers.

For example, when a multi-anode photomultiplier having a plurality of anodes so as to correspond to a plurality of electron-multiplier configurations respectively constituting electron-multiplier channels is manufactured by microfabrication, spacing between the anodes as well are markedly made narrow, which increases the possibility of bringing about a reduction in detection accuracy or a variation in detection accuracy of each manufactured photomultiplier due to cross talk among the respective channels.

The present invention is made to solve the aforementioned problem, and it is an object to provide a photomultiplier having a fine structure capable of obtaining higher detection accuracy.

Means for Solving the Problems

A photomultiplier according to the present invention is an optical sensor having an electron-multiplier section cascade-multiplying photoelectrons generated by a photocathode, and depending on a layout position of the photocathode, there is a photomultiplier having a transmission type photocathode emitting photoelectrons in a direction which is the same as a direction of incident light, or a photomultiplier having a reflection type photocathode emitting photoelectrons in a direction different from the incident direction of light. In particular, the electron-multiplier section has a plurality of groove portions which will be respectively electron-multiplier channels, and the aforementioned photomultiplier is a multi-anode photomultiplier having a plurality of anodes so as to correspond to the plurality of groove portions (electron-multiplier channels).

In concrete terms, the photomultiplier comprises a housing whose inside is maintained in a vacuum state, a photocathode accommodated in the housing, an electron-multiplier section accommodated in the housing, and anodes whose at least parts are accommodated in the housing. The housing is constituted by a lower frame comprised of a glass material, a sidewall frame in which the electron-multiplier section and the anodes are integrally etched, and an upper frame comprised of a glass material or a silicon material.

The electron-multiplier section has a plurality of groove portions or a plurality of through-holes extending along an electron traveling direction. Each of groove portions is defined by a pair of wall parts onto which microfabrication has been performed with an etching technology, and secondary electron emission surfaces, for cascade-multiplying photoelectrons from the photocathode, are formed on the respective surfaces of the pair of wall parts defining the groove portion, which functions as one electron-multiplier channel. In the same way, each through-hole is defined by wall parts onto which microfabrication has been performed with an etching technology, and secondary electron emission surfaces, for cascade-multiplying photoelectrons from the photocathode, are formed on the surfaces of the wall parts defining the through-hole, which functions as one electron-multiplier channel.

In particular, in the photomultiplier according to the present invention, the above-described anodes are disposed so as to respectively correspond to the plurality of groove portions provided in the electron-multiplier section, and are constituted by a plurality of channel electrodes which are disposed at least partially in spaces sandwiched between pairs of wall parts defining corresponding groove portions. Furthermore, in a case of a configuration in which a plurality of through-holes are provided as electron-multiplier channels in the electron-multiplier section, the anodes are provided so as to respectively correspond to the plurality of through-holes provided in the electron-multiplier section, and are constituted by a plurality of channel electrodes which are disposed at least partially in spaces sandwiched between pairs of wall parts defining corresponding through-holes. In either configuration, each channel electrode functions as an anode allocated to one of the electron-multiplier channels.

As described above, as a multi-anode photomultiplier, due to the anodes being constituted by a plurality of channel electrodes, and the respective channel electrodes being disposed so as to be partially inserted in groove portions or through-holes, secondary electrons multiplied in the respective groove portions or secondary electrons multiplied in the respective through-holes exactly reach corresponding channel electrodes (a reduction in cross talk among the electron-multiplier channels), and higher detection accuracy can be obtained.

Here, in a case in which the electron-multiplier section has a plurality of groove portions as electron-multiplier channels, the respective channel electrodes constituting the above-described anodes preferably have protruding portions whose tips are inserted in spaces sandwiched between pairs of wall parts defining corresponding groove portions. Also, in a case in which the electron-multiplier section has a plurality of through-holes as electron-multiplier channels, the respective channel electrodes constituting the above-described anodes preferably have protruding potions whose tips are inserted in spaces sandwiched between wall parts defining corresponding through-holes.

At this time, the respective channel electrodes constituting the above-described anodes preferably have a configuration in which a main body portion thereof is fixed to a part of the housing, and a protruding portion thereof is supported by the main body portion so as to be spaced by a predetermined distance from the housing.

In the photomultiplier according to the present invention, the respective channel electrodes constituting the above-described anodes are preferably comprised of silicon as a material easy to perform microfabrication.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

Effects of the Invention

As described above, in accordance with the present invention, a plurality of the respective channel electrodes constituting the anodes, which are provided so as to correspond to a plurality of groove portions or through-holes respectively corresponding to electron-multiplier channels, are disposed so as to be partially inserted in corresponding groove portions or through-holes, and therefore cross talk among the channels is effectively reduced, as a result, it is possible to obtain high detection accuracy.

DESCRIPTION OF THE REFERENCE NUMERALS

1*a*: photomultiplier; 2: upper frame; 3: sidewall frame; 4: lower frame (glass substrate); 22: photocathode; 31: electron-multiplier section; 32: anode; 42: anode terminal; and 320 channel electrode.

BEST MODES FOR CARRYING OUT THE INVENTION

In the following, respective embodiments of a photomultiplier according to the present invention will be explained in detail by using FIGS. 1 to 9. In the explanation of the drawings, constituents identical to each other will be referred to with numerals identical to each other without repeating their overlapping descriptions.

Figure 1:
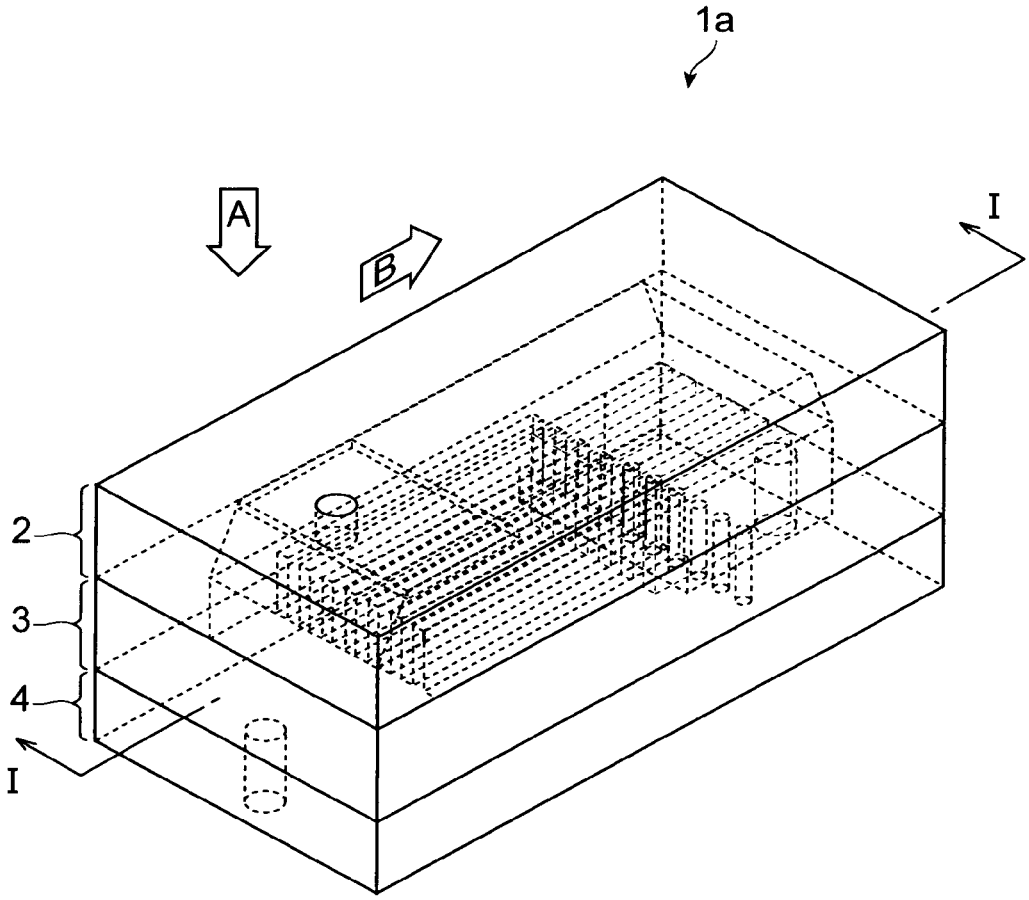
FIG. 1 is a perspective view showing a configuration of one embodiment of a photomultiplier according to the present invention.

FIG. 1 is a perspective view showing a configuration of one embodiment of the photomultiplier according to the present invention. A photomultiplier 1*a* shown in FIG. 1 is a photomultiplier having a transmission type photocathode, and comprises a housing constituted by an upper frame 2 (a glass substrate), a sidewall frame 3 (a silicon substrate), and a lower frame 4 (a glass substrate). The photomultiplier 1*a* is a multi-anode photomultiplier in which a incident direction of light to the photocathode and an electron traveling direction in an electron-multiplier section cross each other, i.e., when light is incident from a direction indicated by an arrow A in FIG. 1, photoelectrons emitted from the photocathode are incident into the electron-multiplier section, and cascade-multiplication of secondary electrons is carried out every electron multiplier channel due to the photoelectrons traveling in a direction indicated by an arrow B, and signals are detected at an anode corresponding to each channel. Subsequently, the respective components will be described.

Figure 2:
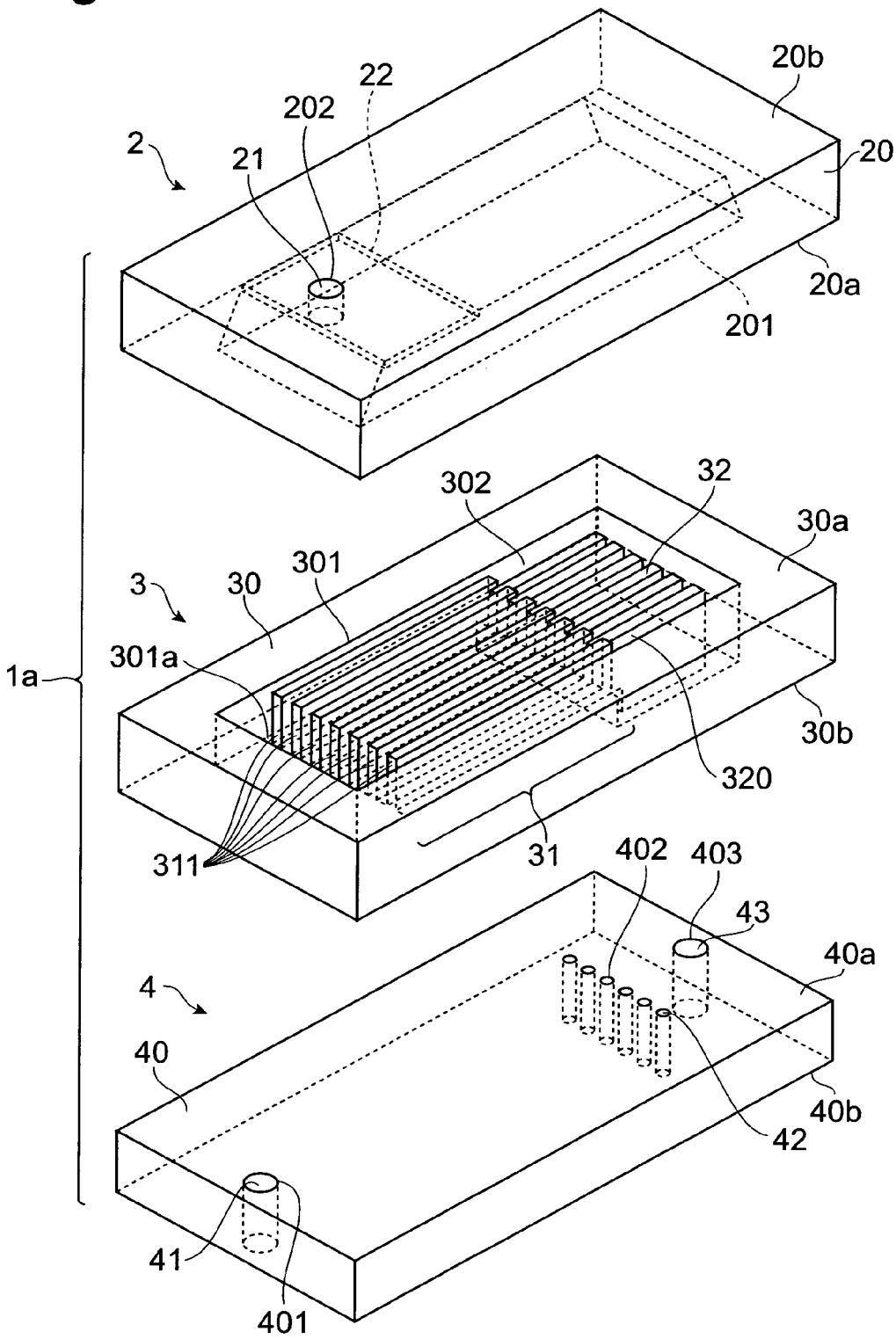
FIG. 2 is an assembly process drawing of the photomultiplier shown in FIG. 1.

FIG. 2 is a perspective view showing the photomultiplier 1*a* shown in FIG. 1 so as to be disassembled into the upper frame 2, the sidewall frame 3, and the lower frame 4. The upper frame 2 is comprised of a rectangular flat plate shaped glass substrate 20 serving as a base material. A rectangular depressed portion 201 is formed on a main surface 20*a* of the glass substrate 20, and the periphery of the depressed portion 201 is formed along the periphery of the glass substrate 20. A photocathode 22 is formed at the bottom of the depressed portion 201. This photocathode 22 is formed near one end in a longitudinal direction of the depressed portion 201. A hole 202 is provided to a surface 20*b* facing the main surface 20*a* of the glass substrate 20, and the hole 202 reaches the photocathode 22. A photocathode terminal 21 is disposed in the hole 202, the photocathode terminal 21 is made to electrically contact the photocathode 22. Note that, in the first embodiment, the upper frame 2 itself comprised of a glass material functions as a transmission window.

The sidewall frame 3 is constituted by a rectangular flat plate shaped silicon substrate 30 serving as a base material. A depressed portion 301 and a penetration portion 302 are formed from a main surface 30*a* of the silicon substrate 30 toward a surface 30*b* facing it. The both openings of the depressed portion 301 and the penetration portion 302 are rectangular, and the depressed portion 301 and the penetration portion 302 are coupled with one another, and the peripheries thereof are formed along the periphery of the silicon substrate 30.

An electron-multiplier section 31 is formed in the depressed portion 301. The electron-multiplier section 31 has a plurality of wall parts 311 installed upright so as to be along one another from a bottom 301*a* of the depressed portion 301.

Groove portions are formed as electron-multiplier channels among the respective wall parts 311 in this way. Secondary electron emission surfaces comprised of secondary electron emission materials are formed at the sidewalls of the wall parts 311 (sidewalls defining the respective groove portions) and the bottom 301*a*. The wall parts 311 are provided along a longitudinal direction of the depressed portion 301, and one ends thereof are disposed to be spaced by a predetermined distance from one end of the depressed portion 301, and the other ends are disposed at positions facing the penetration portion 302. Anodes 32 are disposed in the penetration portion 302. Note that, as electron-multiplier channels, not only the groove portions among the respective wall parts 311, but also the region of the inner wall of the sidewall frame 2 (inner side of the housing) corresponding to the electron-multiplier section 31 and the groove portions between the wall parts 311 adjacent to the regions as well can be utilized.

Note that the anodes 32 are constituted by a plurality of channel electrodes 320 (which are electrically isolated respectively) provided to respectively correspond to the groove portions, and these channel electrodes 320 are disposed to provide a void part from the inner wall of the penetration portion 302, and main body portions thereof are fixed to the lower frame 4 by anode joining, diffusion joining, and still further joining using a sealing material such as low melting metal (for example, indium, etc.), or the like (hereinafter, a case merely described as joining denotes any one of these joining methods). On the other hand, the respective channel electrodes 320 have protruding portions partially inserted in the spaces defined by the wall parts 311 defining the groove portions, and the protruding portions are supported with the main body portions so as to be spaced by a predetermined distance from the lower frame 4.

The lower frame 4 is comprised of a rectangular flat plate shaped glass substrate 40 serving as a base material. A hole 401, holes 402, and a hole 403 are respectively provided from a main surface 40*a* of the glass substrate 40 toward a surface 40*b* facing it. A photocathode side terminal 41, anode terminals 42, and an anode side terminal 43 are respectively inserted into the hole 401, the holes 402, and the hole 403 to be fixed. Further, the anode terminals 42 are made to electrically contact the anodes 32 of the sidewall frame 3.

Figure 3:
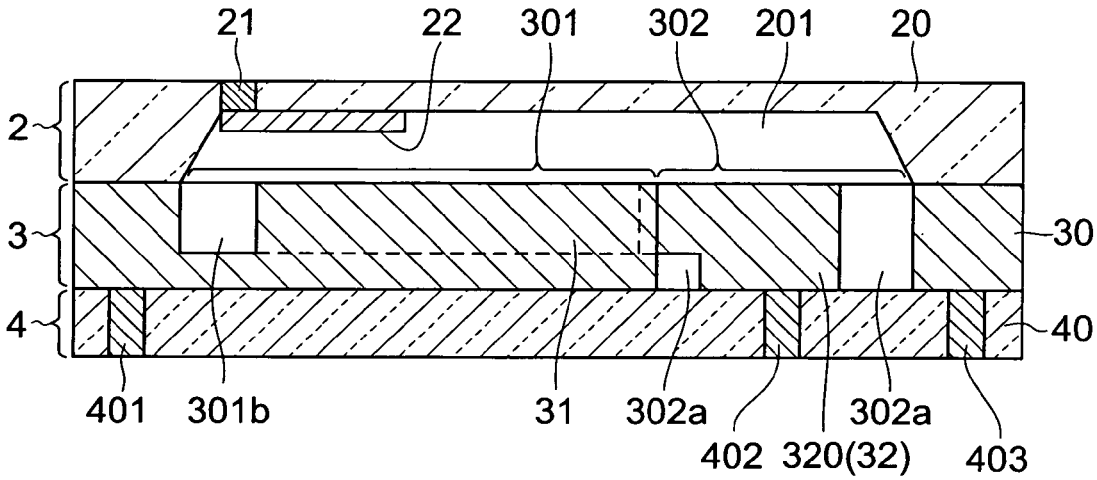
FIG. 3 is a cross-sectional view showing a configuration of the photomultiplier taken along line I-I in FIG. 1.

FIG. 3 is a cross-sectional view showing a configuration of the photomultiplier 1*a* taken along line I-I in FIG. 1. As described above, the photocathode 22 is formed at the bottom portion on the one end of the depressed portion 201 of the upper frame 2. The photocathode terminal 21 is made to electrically contact the photocathode 22, and a predetermined voltage is applied to the photocathode 22 via the photocathode terminal 21. By joining of the main surface 20*a* of the upper frame 2 (see FIG. 2) and the main surface 30*a* of the sidewall frame 3 (see FIG. 2), the upper frame 2 is fixed to the sidewall frame 3.

The depressed portion 301 and the penetration portion 302 of the sidewall frame 3 are disposed at the position corresponding to the depressed portion 201 of the upper frame 2. The electron-multiplier section 31 is disposed in the depressed portion 301 of the sidewall frame 3, and a void part 301*b* is formed between the wall at one end of the depressed portion 301 and the electron-multiplier section 31. In this case, one end of the electron-multiplier section 31 of the sidewall frame 3 is to be positioned directly beneath the photocathode 22 of the upper frame 2. The channel electrodes 320 constituting the anodes 32 are respectively disposed in the penetration portion 302 of the sidewall frame 3. Because the protruding portions of the respective channel electrodes 320 are disposed not to contact the inner wall of the penetration portion 302, a void part 302*a* is formed between the protruding portions of the respective channel electrodes 320 and the penetration portion 302. Further, the protruding portions of the respective channel electrodes 320 and corresponding spaces defining the associated dynode channels are disposed so as to be partially overlapped in FIG. 3 (a part of a protruding portion is inserted in a corresponding space defining the associated dynode channel). The protruding portion of the channel electrode 320 which is inside the corresponding space defining the associated dynode channel of the electron-multiplier section 31 has length shorter than the length of the protruding portion which is outside the space defining the associated dynode channel. The cross sectional area of the protruding portion of the channel electrode 320 is smaller than the cross sectional area of the main body of the channel electrode.

By joining of the surface 30*b* of the sidewall frame 3 (see FIG. 2) and the main surface 40*a* of the lower frame 4 (see FIG. 2), the lower frame 4 is fixed to the sidewall frame 3. At this time, the electron-multiplier section 31 of the sidewall frame 3 as well is fixed to the lower frame 4 by joining. By joining of the upper frame 2 and the lower frame 4 respectively formed of glass materials to the sidewall frame so as to sandwich the sidewall frame 3, the housing of the photomultiplier 1*a* is obtained. Note that a space is formed inside the housing, vacuum-tight processing is performed at the time of assembling the housing constituted by the upper frame 2, the sidewall frame 3, and the lower frame 4, which maintains the inside of the housing in a vacuum state (as will hereinafter be described in detail).

The photocathode side terminal 401 and the anode side terminal 403 of the lower frame 4 are respectively made to electrically contact the silicon substrate 30 of the sidewall frame 3, and therefore it is possible to generate an electric potential difference in a longitudinal direction of the silicon substrate 30 (a direction crossing a direction in which photoelectrons are emitted from the photocathode 22, and a direction in which secondary electrons travel in the electron-multiplier section 31) by applying predetermined voltages respectively to the photocathode side terminal 401 and the anode side terminal 403. Furthermore, the anode terminals 402 of the lower frame 4 are prepared for each of the channel electrodes 320 of the sidewall frame 3 (made to electrically contact the anodes 32), and it is possible to take out electrons reaching each of the channel electrodes 320 as signals.

Figure 4:
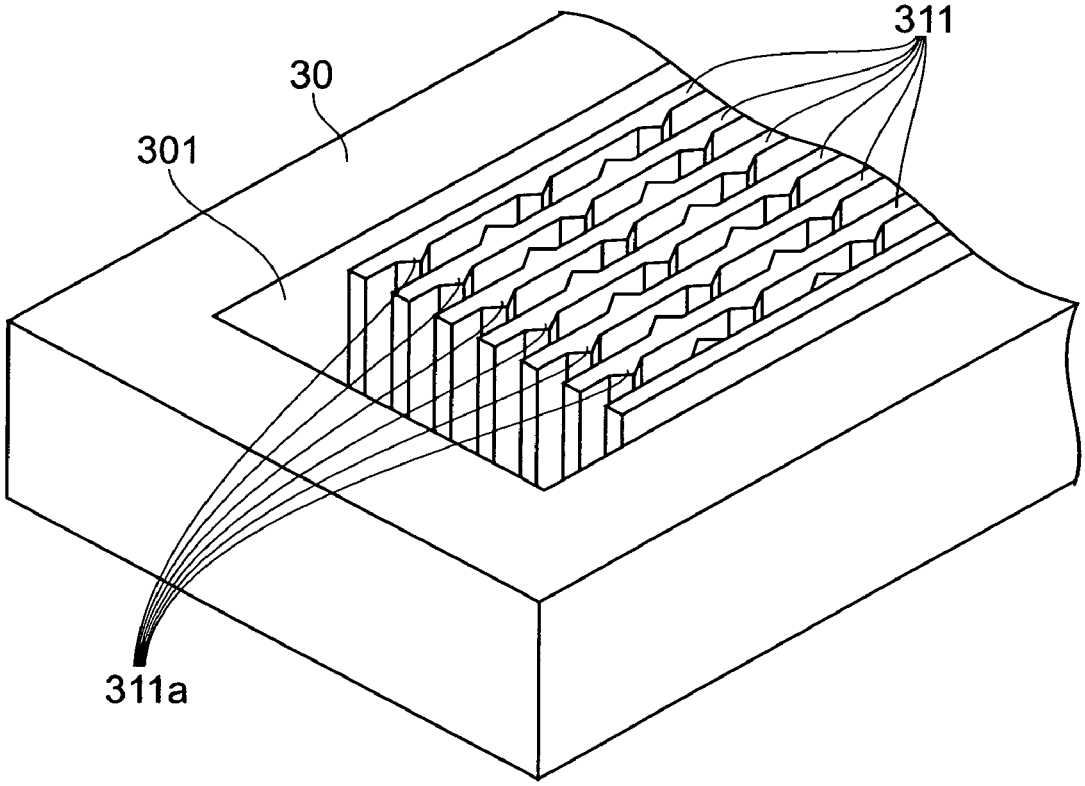
FIG. 4 is a perspective view showing a configuration of an electron-multiplier section in the photomultiplier shown in FIG. 1.

In FIG. 4, a configuration near the wall parts 311 of the sidewall frame 3 is shown. The protruding portions 311*a* are formed on the sidewalls of the wall parts 311 disposed in the depressed portion 301 of the silicon substrate 30. The protruding portions 311*a* are alternately disposed so as to be alternated on the wall parts 311 facing one another. The protruding portions 311*a* are formed evenly from the upper ends to the lower ends of the wall parts 311.

The photomultiplier 1*a* operates as follows. That is, −2000V is applied to the photocathode side terminal 401 of the lower frame 4, and 0V is applied to the anode side terminal 403, respectively. Note that a resistance of the silicon substrate 30 is about 10 MΩ. Furthermore, a value of resistance of the silicon substrate 30 can be adjusted by changing a volume, for example, a thickness of the silicon substrate 30. For example, a value of resistance can be increased by making a thickness of the silicon substrate thinner. Here, when light is incident into the photocathode 22 via the upper frame 2 comprised of a glass material, photoelectrons are emitted from the photocathode 22 toward the sidewall frame 3. The emitted photoelectrons reach the electron-multiplier section 31 positioned directly beneath the photocathode 22. Since an electric potential difference is generated in the longitudinal direction of the silicon substrate 30, the photoelectrons reaching the electron-multiplier section 31 head for the side of the anodes 32. The groove portions defined by the plurality of wall parts 311 are formed as electron-multiplier channels in the electron-multiplier section 31. That is, the photoelectrons reaching the electron-multiplier section 31 from the photocathode 22 collide against the sidewalls of the wall parts 311 and the bottom 301*a* among the wall parts 311 facing one another, and a plurality of secondary electrons are emitted. In the electron-multiplier section 31, cascade-multiplication of secondary electrons is carried out one after another at every electron-multiplier channel, and $10^5$ to $10^7$ secondary electrons are generated per photoelectron reaching the electron-multiplier section from the photocathode. The generated secondary electrons reach a corresponding channel electrode 320 to be taken out as signals from the anode terminals 402.

Next, an effective layout relationship between the channel electrodes 320 constituting the anodes 32 and the groove portions will be explained by using FIG. 5.

Figure 5:
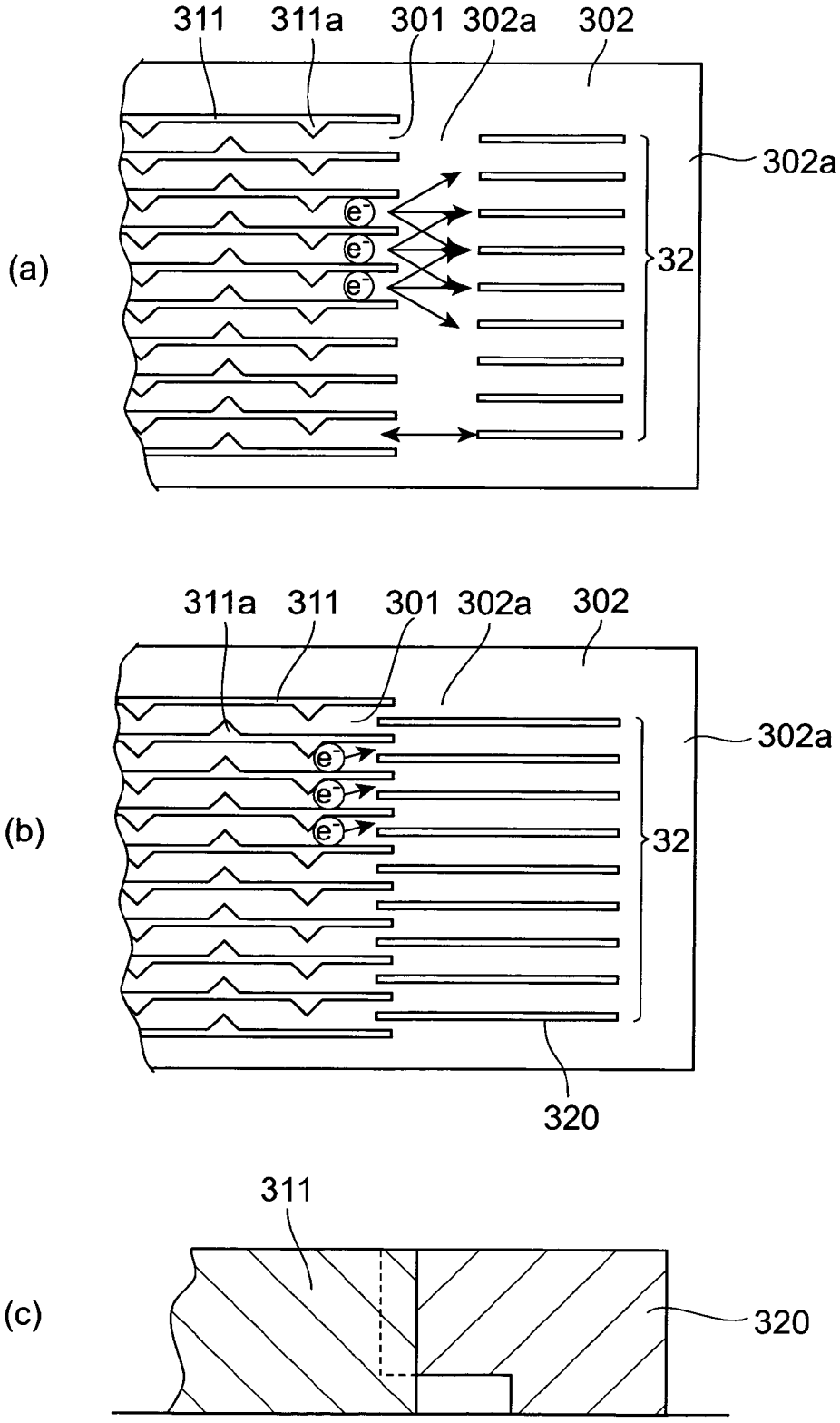
FIG. 5 illustrates diagrams for explaining an effective positional relationship between groove portions and anodes in the electron-multiplier section.

First, in the area (a) of FIG. 5, a configuration is shown as a comparative example in which the plurality of channel electrodes constituting the anodes 32 are disposed at positions separated by a distance to have an electric potential difference V from the anode side end of the electron-multiplier section 31. In a case of a configuration as shown in the area (a) of FIG. 5, secondary electrons cascade-multiplied in the groove portions serving as electron-multiplier channels travel toward the side of the anodes 32 at a predetermined spreading angle from the electron emission terminals of the groove portions. In this way, electrons emitted from a certain groove portion travel at a predetermined spreading angle, and therefore a possibility that the electrons reach channel electrodes different from a channel electrode corresponding to the groove portion is made extremely high. That is, cross talk among electron-multiplier channels is made easy to occur. In this case, in the photomultiplier having the configuration shown in the area (a) of FIG. 5, there are cases in which sufficient detection accuracy cannot be obtained.

On the other hand, as shown in the area (b) of FIG. 5, in a configuration in which the respective channel electrodes 320 constituting the anodes 32 are partially inserted in the spaces sandwiched between pairs of the wall parts 311 defining the groove portions of the electron-multiplier section 31, the problem as described above is solved, and it is possible to dramatically improve the detection accuracy.

That is, in a configuration in which a tip of one corresponding channel electrode 320 is inserted in a space sandwiched between a pair of wall parts defining one groove portion (one electron-multiplier channel), because secondary electrons cascade-multiplied at the wall parts 311 defining a groove portion and the bottom 301 are not emitted from the end of the groove portion, but directly reach the channel electrode 320 corresponding thereto, cross talk among the electron-multiplier channels does not occur structurally. Therefore, after the electrons from the photocathode 22 are cascade-multiplied in a groove portion, these exactly reach the channel electrode 320 corresponding to the groove portion, and higher detection accuracy can be obtained.

Note that the area (c) of FIG. 5 is a diagram from a lateral view in the area (b) of FIG. 5, the wall parts 311 defining the respective groove portions and the protruding portions of the corresponding channel electrodes 320 are partially overlapped with one another so as to be spaced by a predetermined distance from the lower frame 4. That is, the channel electrodes 320 have protruding portions on the end at the electron-multiplier section 31 side, and the protruding portions are disposed spatially so as to be spaced by a predetermined distance from the lower frame 4. Because of the state in which these protruding portions and the lower frame 4 are spaced by the predetermined distance, it is possible to shorten a spatial distance between the wall parts 311 and the corresponding channel electrodes 320 (the protruding portions more in detail), and to keep a sufficient distance as a creepage distance thereof via the lower frame 4. As in this example, in a case in which the electron-multiplier section 31 and the anodes 32 are disposed on the same substrate surface and are made to have a fine structure, at the time of determining a distance between the both, a withstand voltage between the both and an electron collection efficiency in the anodes 32 are conflicting problems. However, in a state in which these are spaced by a predetermined distance in this way, because a creepage distance can be sufficiently ensured and these are spatially close to one another, it is possible to improve an electron collection efficiency and to suppress cross talk among the channels without bringing about a problem from the standpoint of a withstand voltage.

In the above-described embodiment, the photomultiplier having a transmission type photocathode has been described. However, the photomultiplier according to the present invention may have a reflection type photocathode. For example, by forming a photocathode on the end opposite the anode side terminal in the electron-multiplier section 31, a photomultiplier having a reflection type photocathode can be obtained. Furthermore, by forming an inclined surface facing the anode side at an end side opposite the anode side of the electron-multiplier section 31, and by forming a photocathode on the inclined surface, a photomultiplier having a reflection type photocathode can be obtained. In either configuration, it is possible to obtain a photomultiplier having a reflection type photocathode in a state of having other configurations which are the same as those of the above-described photomultiplier 1*a*.

Also, in the above-described embodiment, the electron-multiplier section 31 disposed in the housing is formed integrally so as to contact the silicon substrate 30 constituting the sidewall frame 3. However, in a state in which the sidewall frame 3 and the electron-multiplier section 31 contact one another in this way, there is a possibility that the electron-multiplier section 31 is under the influence of external noise via the sidewall frame 3, which deteriorates detection accuracy. Then, the electron-multiplier section 31 and the anodes 32 (channel electrodes 320) formed integrally with the sidewall frame 3 may be respectively disposed in the glass substrate 40 (the lower frame 4) so as to be spaced by a predetermined distance from the sidewall frame 3. To describe concretely, the void part 301*b* is made to be a penetration portion, and the photocathode side terminal 401 is disposed to electrically contact the photocathode side end of the electron-multiplier section 31, and the anode side terminal 403 is disposed to electrically contact the anode side end of the electron-multiplier section 31.

Furthermore, in the above-described embodiment, the upper frame 2 constituting a part of the housing is comprised of the glass substrate 20, and the glass substrate 20 itself functions as a transmission window. However, the upper frame 2 may be comprised of a silicon substrate. In this case, a transmission window is formed at any one of the upper frame 2 or the sidewall frame 3. As a method for forming a transmission window, for example, etching is carried out onto the both surfaces of an SOI (Silicon On Insulator) substrate in which a spatter glass substrate is sandwiched from the both sides by silicon substrates, and an exposed part of the spatter glass substrate can be utilized as a transmission window.

Further, a columnar or mesh pattern may be formed in several μm on a silicon substrate, and this portion may be thermally oxidized to be glass. In addition, etching may be carried out such that a silicon substrate of an area to be formed as a transmission window is made to have a thickness of about several μm, and this may be thermally oxidized to be glass. In this case, etching may be carried out from the both surfaces of the silicon substrate, or etching may be carried out only from one side.

Next, one example of a method for manufacturing the photomultiplier 1*a* shown in FIG. 1 will be described. In a case of manufacturing the aforementioned photomultiplier, a silicon substrate of 4 inches in diameter (a constituent material of the sidewall frame 3 in FIG. 2) and two glass substrates of the same shape (constituent materials of the upper frame 2 and the lower frame 4 in FIG. 2) are prepared. Processes which will be hereinafter described are performed onto those of each minute area (for example, several millimeters square). After the processes which will be hereinafter described are completed, they are divided into each area, which completes the photomultiplier. Subsequently, a method for the processes will be described by using FIG. 6 and FIG. 7.

Figure 6:
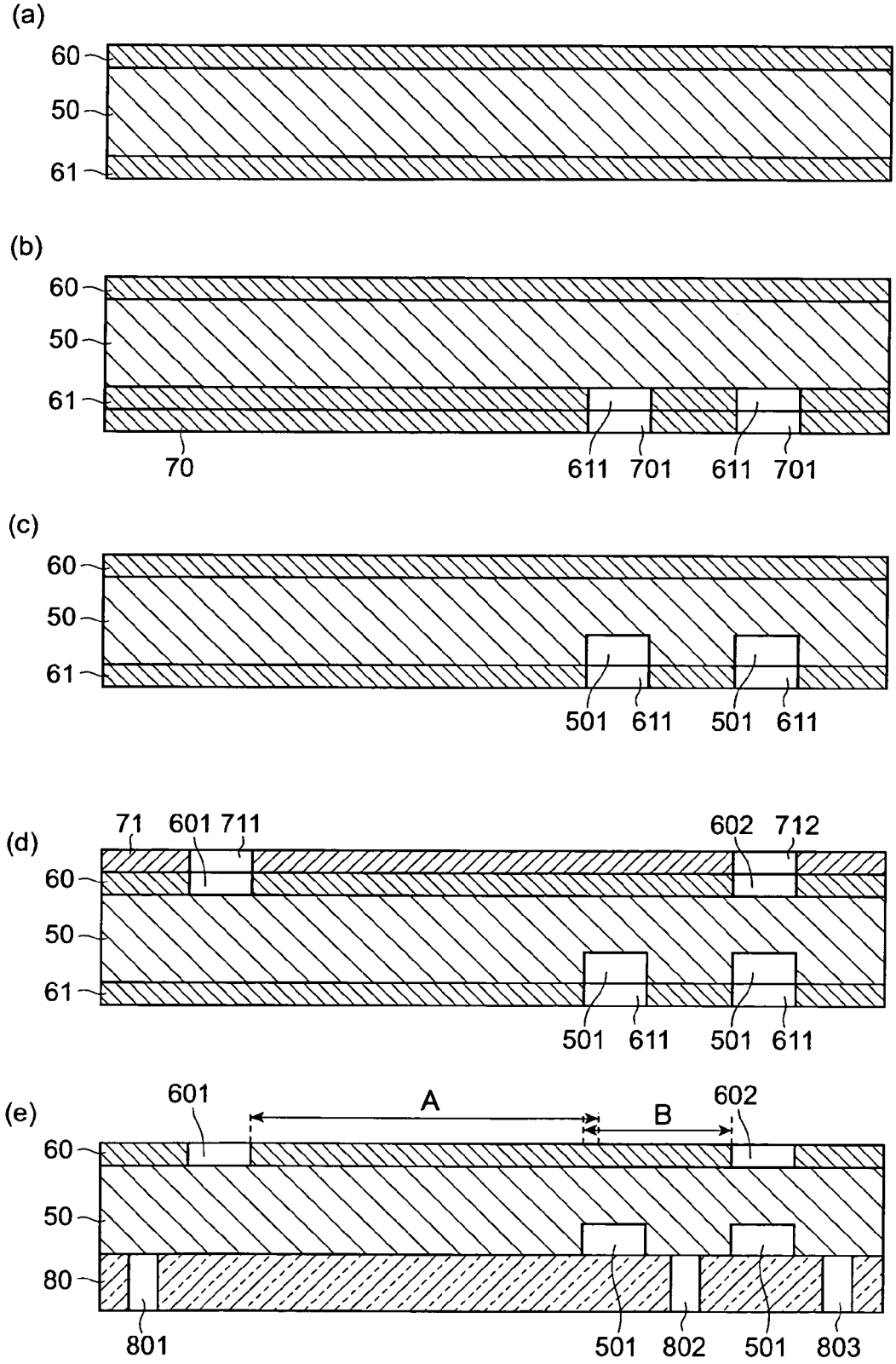
FIG. 6 illustrates diagrams for explaining manufacturing processes for the photomultiplier shown in FIG. 1 (part 1).

First, as shown in the area (a) of FIG. 6, a silicon substrate 50 (corresponding to the sidewall frame 3) with a thickness of 0.3 mm and a specific resistance of 30 kΩ·cm is prepared. A silicon thermally-oxidized film 60 and a silicon thermally-oxidized film 61 are respectively formed on the both surfaces of the silicon substrate 50. The silicon thermally-oxidized film 60 and the silicon thermally-oxidized film 61 function as masks at the time of a DEEP-RIE (Reactive Ion Etching) process. Next, as shown in the area (b) of FIG. 6, a photoresist film 70 is formed on the back surface side of the silicon substrate 50. Removed portions 701 corresponding to the voids between the penetration portion 302 and the respective channel electrodes 320 constituting the anodes 32 in FIG. 2, and removed portions (not shown) for spacing the respective channel electrodes 320 are formed in the photoresist film 70. When etching onto the silicon thermally-oxidized film 61 is carried out in this state, removed portions 611 corresponding to the void parts between the penetration portion 302 and the respective channel electrodes 320 in FIG. 2, and removed portions (not shown) for spacing the respective channel electrodes 320 are formed.

After the photoresist film 70 is removed from the state shown in the area (b) of FIG. 6, a DEEP-RIE process is performed. As shown in the area (c) of FIG. 6, void parts 501 corresponding to the voids between the penetration portion 302 and the channel electrodes 320 in FIG. 2, and spacing portions (not shown) for spacing the respective channel electrodes 320 are formed in the silicon substrate 50. Next, as shown in the area (d) of FIG. 6, a photoresist film 71 is formed on the surface side of the silicon substrate 50. A removed portion 711 corresponding to the void between the wall parts 311 and the depressed portion 301 in FIG. 2, a removed portion 712 corresponding to the void between the penetration portion 302 and the channel electrodes 320 in FIG. 2, removed portions corresponding to the grooves among the wall parts 311 in FIG. 2 (portions shown by an area A in the area (e) of FIG. 6), and penetration portions for spacing the respective channel electrodes 320 (portions shown by an area B in the area (e) of FIG. 6) are formed in the photoresist film 71. When etching onto the silicon thermally-oxidized film 60 is carried out in this state, a removed portion 601 corresponding to the void between the wall parts 311 and the depressed portion 301 in FIG. 2, a removed portion 602 corresponding to the void between the penetration portion 302 and the channel electrodes 320 in FIG. 2, removed portions corresponding to the grooves among the wall parts 311 in FIG. 2, and removed portions corresponding to the channel electrodes 320 which are electrically isolated respectively are formed.

After the silicon thermally-oxidized film 61 is removed from the state shown in the area (d) of FIG. 6, anode joining of a glass substrate 80 (corresponding to the lower frame 4) onto the back surface side of the silicon substrate 50 is carried out (see the area (e) of FIG. 6). A hole 801 corresponding to the hole 401 in FIG. 2, holes 802 corresponding to the holes 402 in FIG. 2, and a hole 803 corresponding to the hole 403 in FIG. 2 are respectively processed in advance in the glass substrate 80. Next, a DEEP-RIE process is performed on the surface side of the silicon substrate 50. The photoresist film 71 functions as a mask material at the time of a DEEP-RIE process, which makes it possible to process at a high aspect ratio. After the DEEP-RIE process, the photoresist film 71 and the silicon thermally-oxidized film 60 are removed. As shown in the area (a) of FIG. 7, by forming penetration portions reaching the glass substrate 80 with respect to the portions onto which the process for the void part 501 and the spacing portions for spacing the respective channel electrodes 320 has been performed in advance from the back surface, island shaped portions 502 corresponding to the channel electrodes 320 in FIG. 2 are formed. These island shaped portions 502 corresponding to the channel electrodes 320 are fixed to the glass substrate 80 by anode joining. In addition, at the time of the DEEP-RIE process, groove portions 51 corresponding to the grooves among the wall parts 311 in FIG. 2 and a depressed portion 503 corresponding to the void between the wall parts 311 and the depressed portion 301 in FIG. 2 as well are formed. Here, secondary electron emission surfaces are formed on the sidewalls and the bottom 301*a* of the groove portions 51. Furthermore, the groove portions 51 corresponding to the grooves among the wall parts 311 and the island shaped portions 52 corresponding to the channel electrodes 320 are in a state in which these are partially overlapped from a lateral view, and in accordance therewith, a configuration is realized in which corresponding channel electrodes 320 are partially inserted in the groove portions.

Subsequently, as shown in the area (b) of FIG. 7, a glass substrate 90 corresponding to the upper frame 2 is prepared. A depressed portion 901 (corresponding to the depressed portion 201 in FIG. 2) is formed by a spot-facing process in the glass substrate 90, and a hole 902 (corresponding to the hole 202 in FIG. 2) is formed so as to reach the depressed portion 901 from the surface of the glass substrate 90. As shown in the area (c) of FIG. 7, a photocathode terminal 92 corresponding to the photocathode terminal 21 in FIG. 2 is inserted into the hole 902 to be fixed, and a photocathode 91 is formed in the depressed portion 901.

Figure 7:
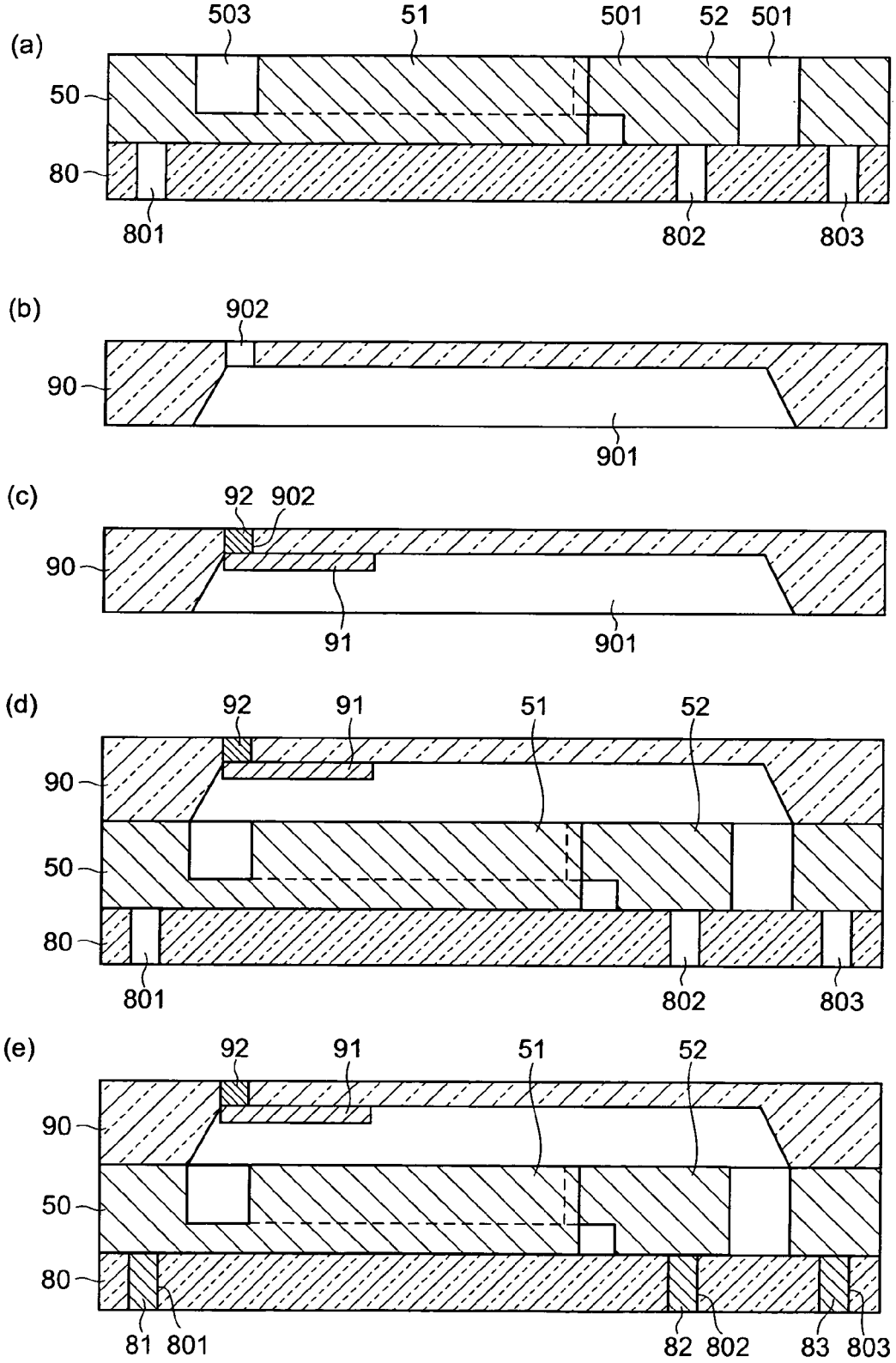
FIG. 7 illustrates diagrams for explaining manufacturing processes for the photomultiplier shown in FIG. 1 (part 2).

The silicon substrate 50 and the glass substrate 80 which have been made to progress up to the process of the area (a) of FIG. 7, and the glass substrate 90 which has been made to progress up to the process of the area (c) of FIG. 7 are joined in a vacuum-tight state as shown in the area (d) of FIG. 7. Thereafter, a photocathode side terminal 81 corresponding to the photocathode side terminal 41 in FIG. 2 is inserted into the hole 801 to be fixed, anode terminals 82 corresponding to the anode terminals 42 in FIG. 2 are inserted into the holes 802 to be fixed, and an anode side terminal 83 corresponding to the anode side terminal 43 in FIG. 2 is inserted into the hole 803 to be fixed, respectively, which leads to a state shown in the area (e) of FIG. 7. Thereafter, due to this being cut out in units of chips, a photomultiplier having a configuration as shown in FIG. 1 and FIG. 2 can be obtained.

Figure 8:
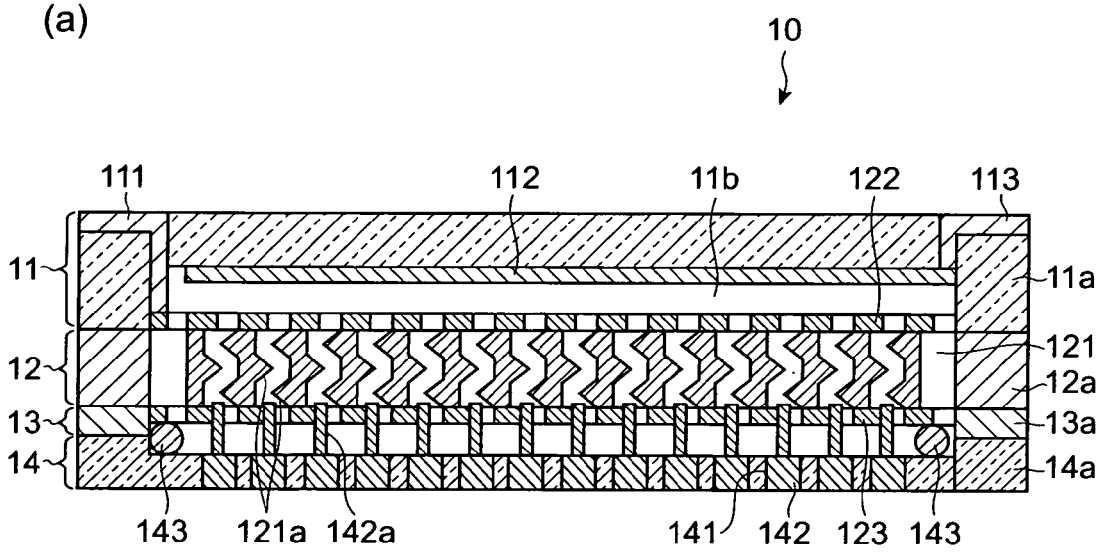
FIG. 8 illustrates diagrams showing configurations of a second embodiment of the photomultiplier according to the present invention.
Figure 8:
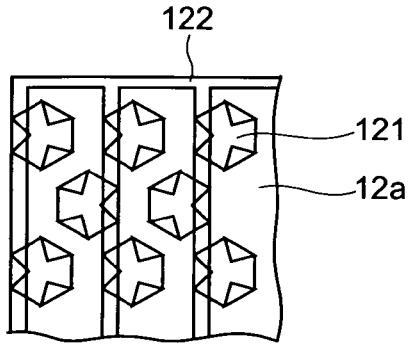

FIG. 8 illustrates diagrams showing a configuration of a second embodiment of the photomultiplier according to the present invention. In FIG. 8, a cross-sectional configuration of a photomultiplier 10 is shown. The photomultiplier 10 is, as shown in the area (a) of FIG. 8, constituted such that an upper frame 11, a sidewall frame 12 (a silicon substrate), a first lower frame 13 (a glass member), and a second lower frame 14 (a substrate) are respectively jointed to one another. The upper frame 11 is comprised of a glass material, and a depressed portion 11*b* is formed on a surface facing the sidewall frame 12. A photocathode 112 is formed over the entire surface of the bottom of the depressed portion 11*b*. A photocathode electrode 113 applying an electric potential to the photocathode 112 and a surface electrode terminal 111 contacting a surface electrode which will be described later are respectively disposed one end and the other end of the depressed portion 11*b*.

In the sidewall frame 12, a large number of holes are provided in parallel with a direction of a tube axis in a silicon substrate 12*a*. The protruding portions 121*a* against which electrons are made to collide are provided to the inner surfaces of the holes 121, and secondary electron emission surfaces are formed on the inner surfaces of the holes 121 including the protruding portions 121*a* (each hole 121 serves as an electron-multiplier channel). Note that an inner wall of the sidewall frame 12 (the inside of the housing) can be utilized as a part of the walls of the electron-multiplier channels. In addition, a surface electrode 122 and a back surface electrode 123 are disposed in the vicinity of the openings at the both ends of each hole 121. A positional relationship between the holes 121 and the surface electrode 122 is shown in the area (b) of FIG. 8. As shown in the area (b) of FIG. 8, the surface electrode 122 is disposed so as to be near by the holes 121. Note that the back surface electrode 123 as well is in the same way. The surface electrode 122 contacts the surface electrode terminal 111, and a back surface terminal 143 is made to contact with the back surface electrode 123. That is, an electric potential is generated in an axial direction of the holes 121 in the sidewall frame 12, and photoelectrons emitted from the photocathode 112 travel downward in the figure in the holes 121.

The first lower frame 13 is a member for coupling the sidewall frame 12 and the second lower frame 14, and is joined to both of the sidewall frame 12 and the second lower frame 14.

The second lower frame 14 is comprised of a silicon substrate 14*a* to which a large number of holes 141 are provided. A plurality of channel electrodes 142 constituting anodes are inserted into the respective holes 141 to be fixed. Furthermore, a protruding portion 142*a* is provided to each of these channel electrodes 142, and the protruding portion 142*a* is fixed so as to be partially inserted in the hole 121.

In the photomultiplier 10 shown in FIG. 8, light incident from the upper side in the figure passes through the glass substrate serving as the upper frame 11 to be incident into the photocathode 112. Photoelectrons are emitted from the photocathode 112 toward the sidewall frame 12 in accordance with the incident light. The emitted photoelectrons enter the holes 121 of the first lower frame 13. The photoelectrons which have entered the holes 121 collide against the inner walls of the holes 112 to generate secondary electrons, and the generated secondary electrons head for the second lower frame 14. These secondary electrons are taken out as signals from the corresponding channel electrodes 142.

Figure 9:
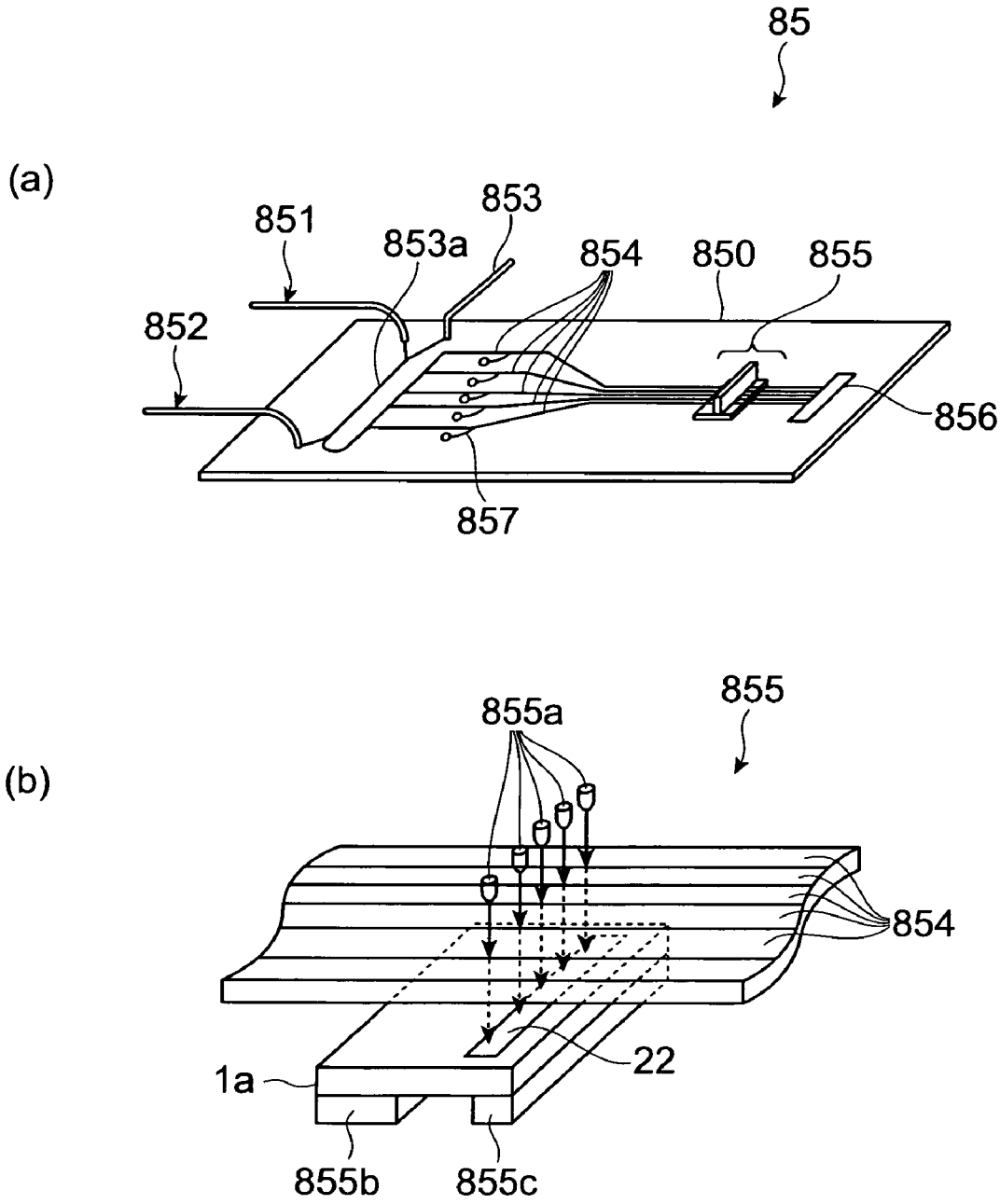
FIG. 9 illustrates diagrams showing configurations of a detection module to which the photomultiplier according to the present invention is applied.

Next, an optical module to which the photomultiplier 1*a* having a configuration as described above is applied will be described. The area (a) of FIG. 9 is a view showing a configuration of an analysis module to which the photomultiplier 1*a* has been applied. An analysis module 85 includes a glass plate 850, a gas inlet pipe 851, a gas exhaust pipe 852, a solvent inlet pipe 853, reagent mixing-reaction paths 854, a detecting element 855, a waste liquid pool 856, and reagent paths 857. The gas inlet pipe 851 and the gas exhaust pipe 852 are provided to introduce or exhaust a gas serving as an object to be analyzed to or from the analysis module 85. The gas introduced from the gas inlet pipe 851 passes through an extraction path 853*a* comprised on the glass plate 850, and is exhausted to the outside from the gas exhaust pipe 852. That is, by making a solvent introduced from the solvent inlet pipe 853 pass through the extraction path 853*a*, when there is a specific material of interest (for example, environmental hormones or fine particles) in the introduced gas, it is possible to extract it in the solvent.

The solvent which has passed through the extraction path 853*a* is introduced into the reagent mixing-reaction paths 854 so as to include the extract material of interest. There are a plurality of the reagent mixing-reaction paths 854, and due to corresponding reagents being introduced into the respective paths from the reagent paths 857, the reagents are mixed into the solvent. The solvent into which the reagents have been mixed travels toward the detecting element 855 through the reagent mixing-reaction paths 854 while carrying out reactions. The solvent in which detection of the material of interest has been completed in the detecting element 855 is discarded to the waste liquid pool 856.

A configuration of the detecting element 855 will be described with reference to the area (b) of FIG. 9. The detecting element 855 includes a light-emitting diode array 855*a*, the photomultiplier 1*a*, a power supply 855*c*, and an output circuit 855*b*. In the light-emitting diode array 855*a*, a plurality of light-emitting diodes are provided to correspond to the respective reagent mixing-reaction paths 854 of the glass plate 850. Pumping lightwaves (solid line arrows in the figure) emitted from the light-emitting diode array 855*a* are guided into the reagent mixing-reaction paths 854. The solvent in which a material of interest can be included is made to flow in the reagent mixing-reaction paths 854, and after the material of interest reacts to the reagent in the reagent mixing-reaction paths 854, pumping lightwaves are irradiated onto the reagent mixing-reaction paths 854 corresponding to the detecting element 855, and fluorescence or transmitted light (broken-line arrows in the figure) reach the photomultiplier 1*a*. This fluorescence or transmitted light is irradiated onto the photocathode 22 of the photomultiplier 1*a*.

As described above, since the electron-multiplier section having a plurality of grooves (for example, in number corresponding to twenty channels) is provided to the photomultiplier 1*a*, it is possible to detect from which position (from which reagent mixing-reaction path 854) fluorescence or transmitted light has changed. This detected result is outputted from the output circuit 855*b*. Also, the power supply 855*c* is a power supply for driving the photomultiplier 1*a*. Note that, a glass substrate (not shown) is disposed on the glass plate 850, and covers the extraction path 853*a*, the reagent mixing-reaction paths 854, the reagent paths 857 (except for the sample injecting portions) except for the contact portions between the gas inlet pipe 851, the gas exhaust pipe 852, and the solvent inlet pipe 853, and the glass plate 850, the waste liquid pool 856, and sample injecting portions of the reagent paths 857.

As described above, in accordance with the present invention, as a multi-anode photomultiplier, due to the anodes being constituted by a plurality of channel electrodes, and the respective channel electrodes being disposed so as to be partially inserted in the groove portions or the through-holes, secondary electrons multiplied in the respective groove portions or secondary electrons multiplied in the respective through-holes exactly reach corresponding channel electrodes (a reduction in cross talk among the electron-multiplier channels), and higher detection accuracy can be obtained.

In addition, by providing the protruding portions 311*a* having a desired height on the surfaces of the wall parts 311 defining the groove portions of the electron-multiplier section 31, it is possible to dramatically improve the electron-multiplication efficiency.

Furthermore, since the grooves are formed in the electron-multiplier section 31 by performing microfabrication onto the silicon substrate 30*a*, and the silicon substrate 30*a* is joined to the glass substrate 40*a*, there is no vibratory portion. That is, the photomultiplier according to the respective embodiments is excellent in vibration resistance and impact resistance.

Since the plurality of channel electrodes 320 constituting the anodes 32 are joined to the glass substrate 40*a*, there is no metal droplet at the time of welding. Therefore, the photomultiplier according to the respective embodiments is improved in electrical stability, vibration resistance, and impact resistance. Since the channel electrodes 320 are joined to the glass substrate 40*a* at the entire bottom face thereof, the anodes 32 do not vibrate due to impact or vibration. Therefore, the photomultiplier is improved in vibration resistance and impact resistance.

Furthermore, in the manufacture of the photomultiplier, because there is no need to assemble the internal structure, and handling thereof is simple and work hours are shortened. Since the housing (vacuum case) constituted of the upper frame 2, the sidewall frame 3, and the lower frame 4, and the internal structure are integrally built, it is possible to easily downsize the photomultiplier. There are no separate components internally, and therefore electrical and mechanical joining is not required.

In the electron-multiplier section 31, cascade-multiplication of electrons is carried out while electrons collide against the sidewalls of the plurality of grooves formed by the wall parts 311. Therefore, since the configuration is simple and a large number of components are not required, it is possible to easily downsize the photomultiplier.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

INDUSTRIAL APPLICABILITY

The electron-multiplier tube according to the present invention can be applied to various fields of detection requiring detection of low light.

The invention claimed is:

1. A photomultiplier, comprising:

a housing whose inside is maintained in a vacuum state, said housing including an insulating plate which constitutes a part of said housing and has a device mount surface;

a photocathode, accommodated in said housing, emitting electrons to the inside of said housing in response to light taken in via said housing;

an electron-multiplier section, accommodated in said housing, having dynode channels respectively defined by spaces each extending along an electron traveling direction; and anodes, accommodated in said housing, taking out, as signals, electrons having reached among electrons cascade-multiplied in said electron-multiplier section, said anodes being constituted by a plurality of channel electrodes which are provided to respectively correspond to the dynode channels in said electron-multiplier section, wherein both of said electron-multiplier section and said anode are directly fixed on the same device mount surface of said insulating plate, wherein each of said channel electrodes includes a main body directly fixed on an area of the device mount surface excluding an area on which said electron-multiplier section is directly fixed, and a protruding portion which extends along a direction parallel to the device mount surface of said insulating plate and which has one end located in the space defining the associated dynode channel and the other end supported by said main body while being separated from said insulating plate so as to be located outside of the space defining the associated dynode channel, and wherein, in the direction parallel to the device mount surface of said insulating plate, a length of the portion of said protruding portion which is located in the space defining the associated dynode channel is shorter than that of the portion of said protruding portion which is located outside of the space defining the associated dynode channel.

2. A photomultiplier according to claim 1, wherein said respective channel electrodes constituting said anodes are comprised of silicon.

3. A photomultiplier, comprising:

a housing whose inside is maintained in a vacuum state;

a photocathode, accommodated in said housing, emitting electrons to the inside of said housing in response to light taken in via said housing;

an electron-multiplier section, accommodated in said housing, having a plurality of through-holes extending along an electron traveling direction; and anodes, accommodated in said housing, taking out, as signals, electrons having reached among electrons cascade-multiplied in said electron-multiplier section, said anodes being constituted by a plurality of channel electrodes which are provided to respectively correspond to the plurality of through-holes in said electron-multiplier section, wherein each of said channel electrodes includes a main body penetrating said housing, and a protruding portion extending from said main body toward the associated through-hole, wherein said protruding portion in said each channel electrode has one end located in the associated through-hole and the other end connected to said main body, and a length of the portion of said protruding portion which is located in the associated through-hole is shorter than that of the portion of said protruding portion which is located outside of the associated through-hole, and wherein cross sectional areas of said protruding portion at both ends thereof are respectively smaller than that of said main body.

4. A photomultiplier according to claim 3, wherein said respective channel electrodes structuring said anodes are comprised of silicon.

* * * * *